US005219022A

United States Patent [19]

Martenas et al.

[11] Patent Number: 5,219,022

[45] Date of Patent: Jun. 15, 1993

[54] RADIATOR FOR VEHICLE COOLING SYSTEM

[75] Inventors: Wayne B. Martenas, New Holland, Pa.; Patrick J. Coyne, Basildon, England

[73] Assignee: Ford New Holland, Inc., New Holland, Pa.

[21] Appl. No.: 888,674

[22] Filed: May 27, 1992

[30] Foreign Application Priority Data

May 28, 1991 [EP] 05281991 ..... 91201267.1

[51] Int. Cl.[5] ..... F01P 11/02; F01P 11/18

[52] U.S. Cl. ..... 165/104.32; 165/11.1; 123/41.54

[58] Field of Search ..... 165/104.32, 917; 123/41.54

[56] References Cited

U.S. PATENT DOCUMENTS 4,130,159 12/1978 Ohta et al. ..... 165/104.32

FOREIGN PATENT DOCUMENTS 0280107 2/1988 European Pat. Off. .

3920898 7/1990 Fed. Rep. of Germany ... 123/41.54

2272858 of 0000 France .

896850 5/1962 United Kingdom ..... 165/104.32

*Primary Examiner*—Albert W. Davis, Jr.

*Attorney, Agent, or Firm*—Larry W. Miller; Frank A. Seemar

[57] ABSTRACT

A radiator for the cooling system of a vehicle, and having a header tank and a bottom tank interconnected by a core through which air can flow, the header tank being provided with a filler tube fitted with a double seal filler cap through which coolant can flow in opposing directions, depending on the conditions pertaining at a given instant in the header tank, is disclosed wherein the header tank is formed integrally with a coolant recovery tank. The coolant recovery tank is connected to the header tank by a passageway extending from the coolant recovery tank to a point in the filler tube of the header tank which is normally on the unpressurized side of the filler cap, but which is connected to the pressurized side of the filler cap when the predetermined coolant pressure set by the pressure relief valve in the filler cap is exceeded.

8 Claims, 4 Drawing Sheets

COLD FILL LEVEL
VII
VIII
IX
13
16
18
19
21
23
24
25
26
27
28
29
31
32
33
35
37
38
39

RADIATOR FOR VEHICLE COOLING SYSTEM

BACKGROUND OF THE INVENTION

This invention relates generally to the cooling system of vehicle engines and, more particularly, to the radiator receiving water heated in the engine block of the vehicle which is then cooled in the radiator by air flowing through the latter either by virtue of the forward movement of the vehicle or a fan urging this air through the radiator.

Conventionally, a radiator has been provided with a filler tube to which is fitted a filler cap having a pressure-relief valve which is disposed to open when the nominal operating pressure of the engine cooling system, of which the radiator forms part, is exceeded. For many years, any coolant flowing through the pressure-relief filler cap valve was merely drained to ground, whereby the overflow coolant was lost. Accordingly, it was necessary regularly to check the coolant level and effect a top up as and when necessary.

In more recent years, the engine cooling systems have been modified in order to conserve any overflow coolant. In one arrangement, a separate coolant recovery or overflow bottle has been provided which is connected to the radiator by a hose and is vented to atmosphere. Any coolant discharged from the radiator due to an excessive increase in coolant pressure in the cooling system, overflows from the radiator into the recovery bottle and is then syphoned back into the radiator when the coolant therein cools. This arrangement works very satisfactorily inasmuch as it eliminates, as far as possible, the introduction of air into the coolant when the overflow coolant is syphoned back into the radiator. This is important because any aeration of the coolant is likely to cause air pockets which, if located within the engine block, can cause undesirable hot spots and furthermore, aeration also can give rise to cavitation which can have an erosive effect. However, the disadvantage of the recovery bottle system is that it increases the component count of the engine cooling system and entails extra assembly operations, and hence, increases manufacturing costs.

An alternative arrangement is to provide a de-aeration tank at the top of the radiator which tank, unlike the recovery bottle, is subjected to the pressure of the cooling system and it is found that the exclusion of air from the coolant subsequently being returned to the radiator from the de-aeration tank is not as efficient as it might be. Accordingly, the deleterious effects of air in the coolant discussed above can manifest themselves with such an arrangement.

It has been found to be desirable to resolve the problems of the aforementioned known vehicle cooling systems by providing a system based on the simple, but highly effective, concept of combining these two prior solutions to the problem of conserving overflow coolant so as to obtain the advantages of lower component count and more efficient de-aeration of the coolant.

SUMMARY OF THE INVENTION

According to the present invention, there is provided a radiator for the cooling system of a vehicle, the radiator including a header tank and a bottom tank interconnected by a core through which air can flow and said header tank being provided with a filler tube fitted with a double seal filler cap through which coolant can flow in opposed directions depending on the conditions pertaining at a given instant in the header tank. The radiator is constructed such that the header tank is formed integrally with a coolant recovery tank, that is connected to the header tank by a passageway extending from the coolant recovery tank to a point in the filler tube of the header tank which is normally on the unpressurized side of the filler cap but which is connected to the pressurized side of the filler cap when the predetermined coolant pressure set by the filler cap is exceeded.

In a preferred arrangement, the header tank assembly, i.e. the overall header tank, is molded from a synthetic plastics material which, for example, may be glass fibre filled NYLON (NYLON being a registered trademark). This molding may leave open the entire underside of the overall header tank including the coolant recovery tank, whereby the underside of this recovery tank needs to be closed in order to prevent coolant communication, other than through said passage way, between said recovery tank and the compartment of the overall header tank assembly forming the conventional header tank. To this end, the coolant recovery tank is closed at the underside by a plate. The plate may be metallic and a gasket may be provided between the plate and a peripheral edge of the recovery tank so as to provide a fluid tight seal. The fact that the side of the plate remote from the coolant recovery tank is subjected to the pressure of the cooling system means that it is usually urged into engagement with the lower peripheral edge of the coolant recovery tank thus serving to enhance, rather than detract from, the sealing engagement of the plate with the recovery tank.

Conveniently, the coolant recovery tank is fitted with its own filler neck and filler cap and in order readily to ascertain when a topping-up operation is required, a sight glass may be provided in a side wall of the coolant recovery tank, with a fill line being provided at the appropriate position at least one side of the sight glass. However, more importantly, the coolant recovery tank is also provided with a vent to atmosphere.

BRIEF DESCRIPTION OF THE DRAWINGS

A radiator for the cooling system of an engine of a vehicle embodying the present invention will now be described in greater detail, by way of example, with reference to the accompanying drawings, in which.

DETAILED DESCRIPTION OF THE PREFERRED EMBODIMENT

Figure 1:
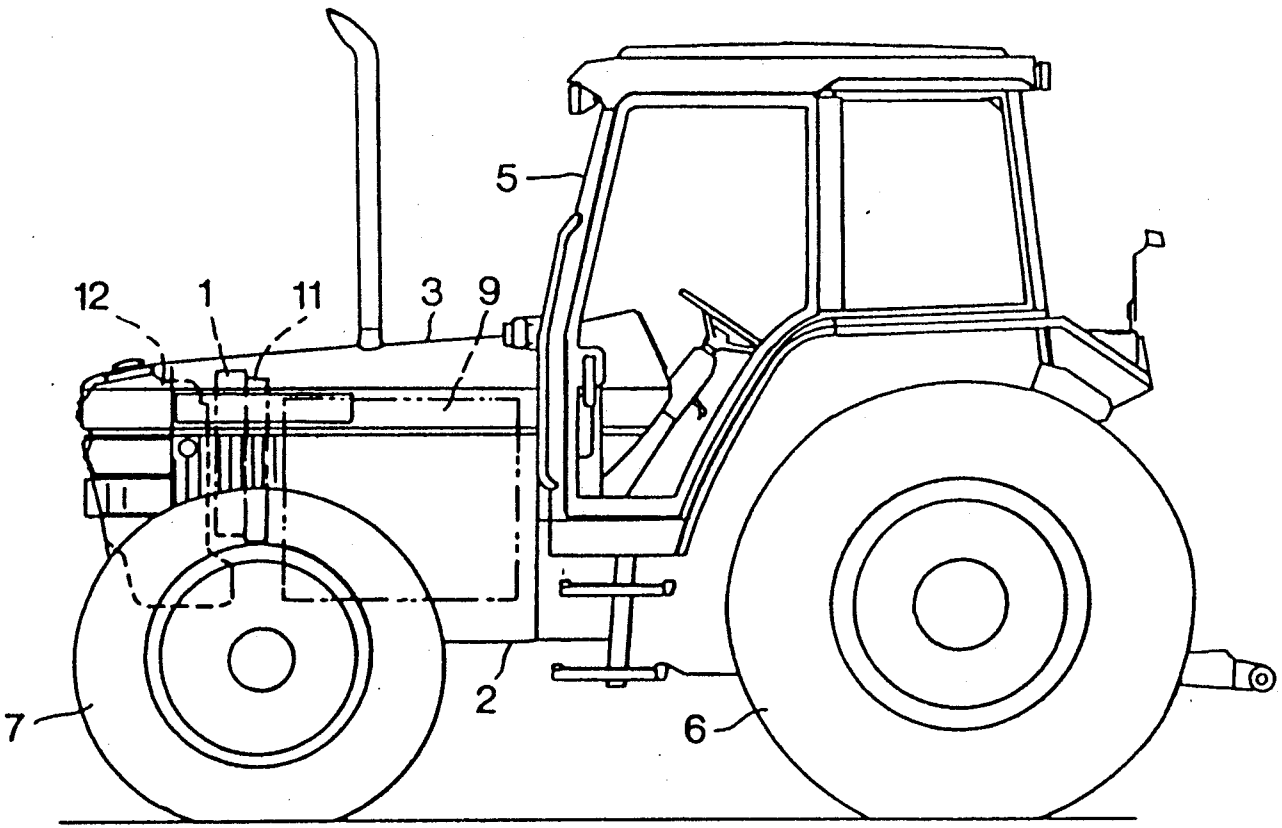
FIG. 1 is a side elevational view of an agricultural tractor embodying the radiator constructed in accordance with the present invention.
Figure 2:
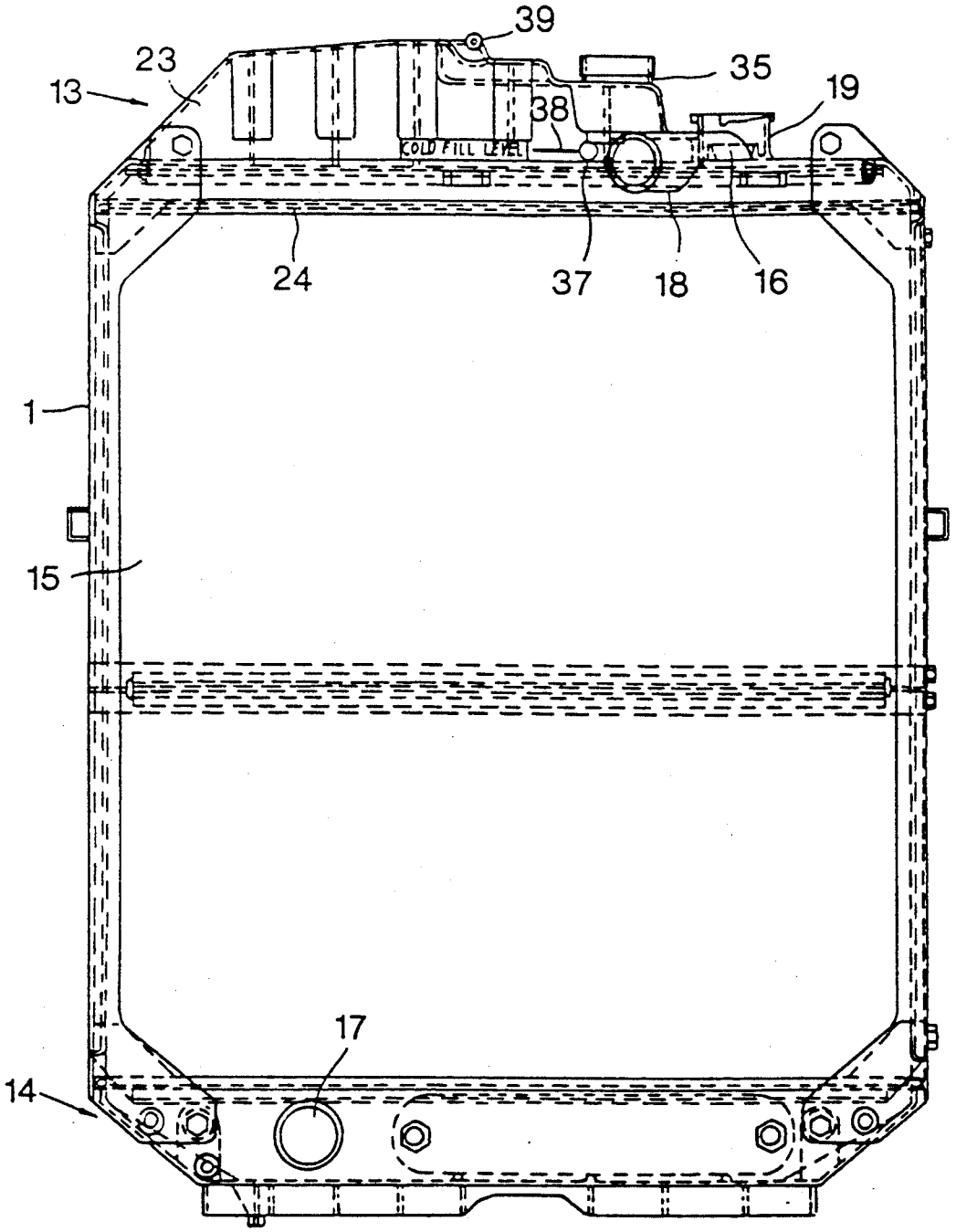
FIG. 2 is a rear view of the radiator.
Figures 3, 4, 5:
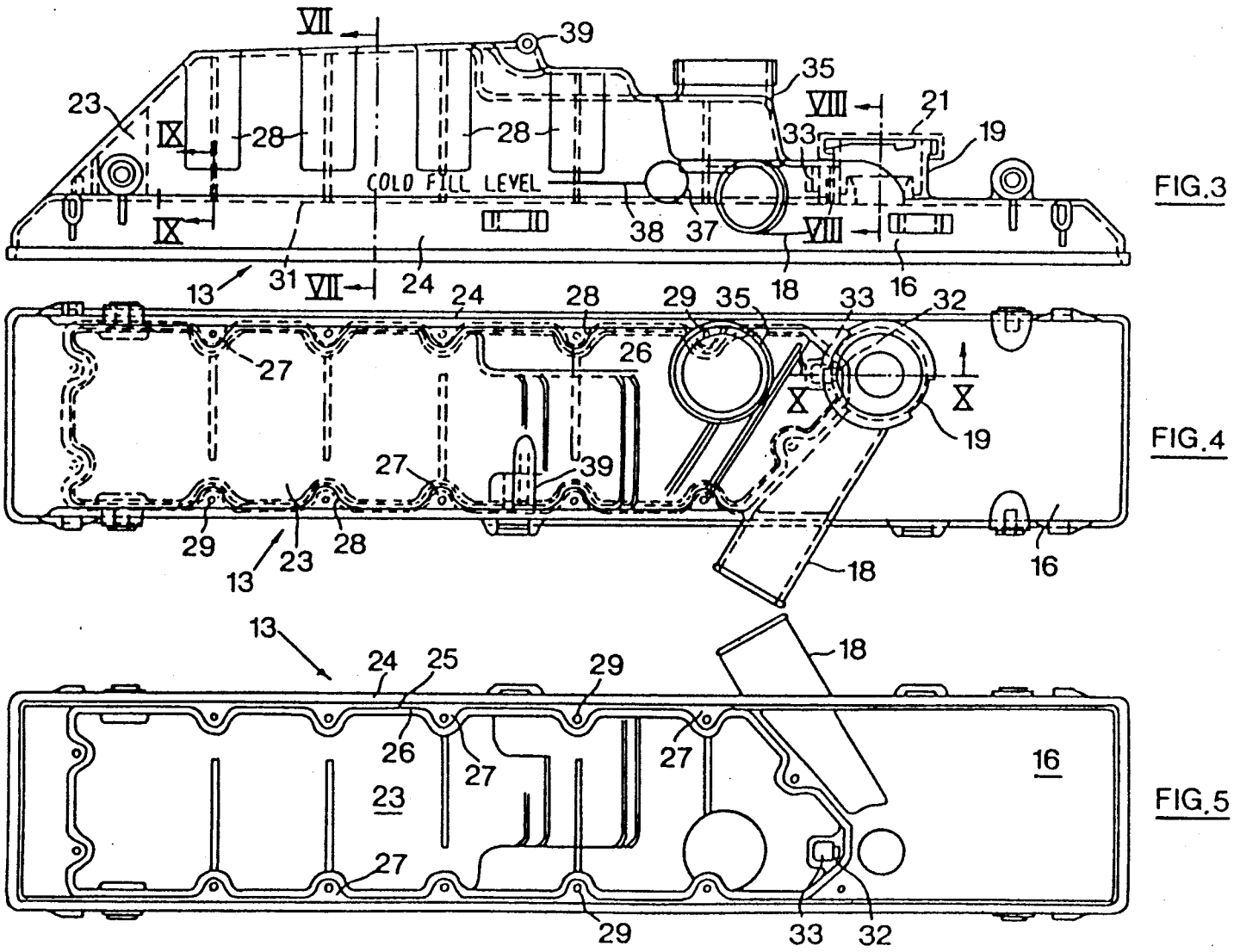
FIG. 3 is a rear view, to an enlarged scale, of the overall header or top tank of the radiator.
FIG. 4 is a top plan view of the top tank of the radiator seen in FIG. 3.
FIG. 5 is a bottom plan view of the top tank of the radiator seen in FIG. 3.
Figure 6:
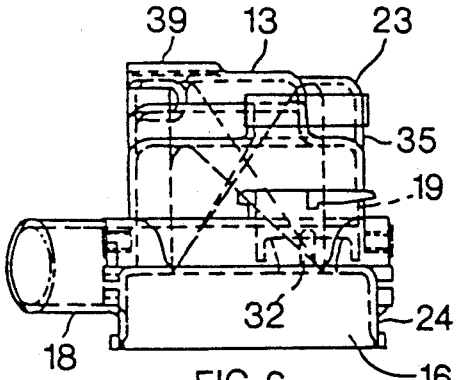
FIG. 6 is a view from the right-hand side of the top tank of the radiator seen in FIG. 3.
Figure 7:
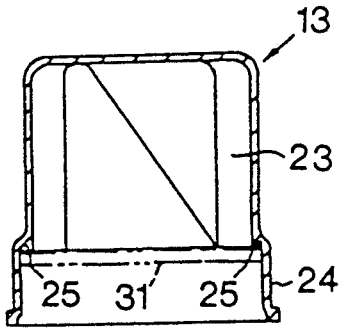
FIG. 7 is a cross-sectional view taken along line VII—VII of FIG. 3.
Figure 8:
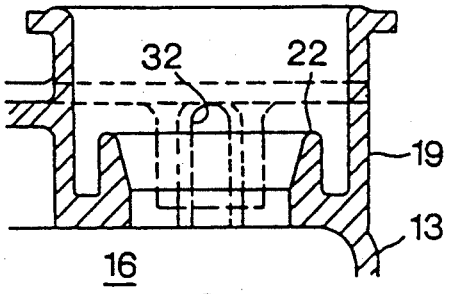
FIG. 8 is a cross-sectional view taken along line VIII—VIII of FIG. 3.
Figure 9:
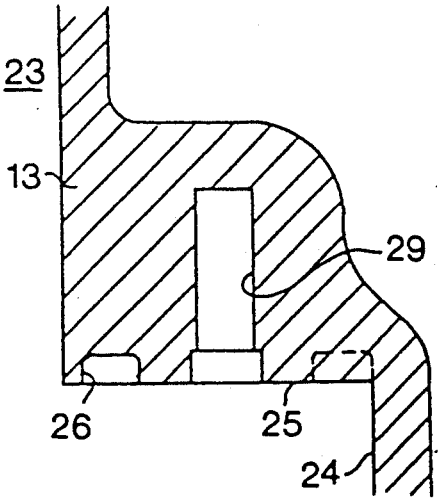
FIG. 9 is a cross-sectional view taken along line IX—IX of FIG. 3.
Figure 10:
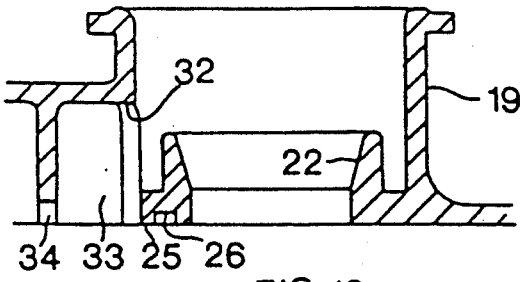
FIG. 10 is a cross-sectional view taken along line X—X of FIG. 4.

Referring first to FIG. 1, an agricultural tractor embodying a radiator 1 constructed in accordance with the present invention can best be seen, although it should be appreciated by one skilled in the art that the radiator may be embodied in any vehicle fitted with an engine cooling system employing a liquid coolant. Any left and right references are used as a matter of convenience and are determined by standing at the rear of the vehicle and facing the forward end, the direction of travel.

The tractor comprises a base structure 2 on which is mounted bodywork including an engine compartment 3. The bodywork also includes an operator cab 5 which is also mounted on the base structure 2. The tractor further comprises a pair of rear, ground-engaging wheels 6 and a pair of front, steerable ground-engaging wheels 7. The rear wheels 6 are driven via a transmission associated with the tractor engine 9 mounted in the engine compartment, together with the radiator 1, a cooling fan 11 mounted rearwardly of the radiator 1 and operable to draw cooling air therethrough, and a fuel tank assembly 12 mounted at the front end of the engine compartment 3.

Turning now to FIGS. 2 to 10, the radiator 1 is shown in greater detail and comprises a top or header tank arrangement 13, a bottom tank 14 and a core 15 interconnecting, in a conventional manner, the header tank arrangement 13 and the bottom tank 14; the core 15 and the bottom tank 14 further also being of conventional design. The header tank arrangement 13 is molded from a synthetic plastics material, for example a glass fibre filled NYLON and has two compartments. The first compartment 16 constitutes the normal radiator header tank which is thus in connection with the bottom tank 14 via the core 15. This part of the radiator 1 is conventional in that coolant heated in the engine block is pumped therein via a coolant inlet 18 and then falls through the individual elements of the core 15 around which cooling air flows, whereby the coolant is cooled by the time it reaches the bottom tank 14 from where it is returned to the engine block via the bottom tank outlet 17. The conventional header tank i.e. the header compartment 16 is fitted with a conventional filler tube or neck 19 and a conventional filler cap 21 (shown in outline in FIG. 3) which is of the double seal type, the valve closure member of the cap being co-operable with a valve seat 22 (FIGS. 8 and 10) provided in the filler neck 19.

The second compartment of the overall header tank 13 provides a coolant recovery tank 23 which is thus formed integrally with the conventional header tank by way of the compartment 16. The overall header tank 13 is provided with a peripheral skirt 24 and inset from the outer edge of this skirt and around the bottom of the recovery tank 23 is a flange 25 (FIGS. 5 and 9) around which is provided a continuous groove 26. The flange or shoulder 25 is formed at intervals with arcuate extensions 27 extending inwardly of the coolant recovery tank 23, the groove 26 following these extensions. The side walls of the coolant recovery tank 23 are formed with indentations 28 in alignment with the arcuate extensions 27 which are provided with apertures 29.

It will be appreciated that it is necessary to isolate the coolant recovery tank 23 from the pressurized coolant of the cooling system and to this end, a plate 31 (shown in outline in FIGS. 3 and 7) is bolted to the flange 25 using the apertures 29 in the arcuate extensions 27. In order to provide a seal between the plate 31 and the flange 25 and thus to form the coolant recovery tank 23 as a watertight container which is separate from the core 15 and indeed also the first header compartment or conventional header tank 16 which is in communication with said core 15, this plate 31 carries a gasket (not shown) which is received in the continuous groove 26. Inasmuch as the side of the plate 31 remote from the gasket is normally subjected to the pressurized coolant in the core 15 and indeed also the header compartment 16 in as much as this header compartment 16 also extends across the full width of the overall top tank assembly 13 beneath the coolant recovery part 23 thereof, then there is normally present a force which urges this plate 31 into sealing engagement with the flange 25 of the coolant recover tank 23 which assists greatly in maintaining the integrity of that watertight seal.

However, it will also be appreciated that although there has to be a basic isolation between the coolant recovery tank 23 and the pressurized coolant in the core 15 and the header compartment 16 forming what is the conventional header tank, there nevertheless is still a need for coolant communication between, on the one hand, said core 15 and indeed also said header tank compartment 16 and, on the other hand, the coolant recovery tank 23 in order to allow for the overflow of coolant from the former to the latter as and when necessary. To this end, the filler neck 19 of the header tank compartment 16 is provided with a generally vertical slot 32 which communicates with a passageway 33 formed in the side wall of the coolant recovery tank 23. The passageway 33 is in communication with the interior of the coolant recovery tank 23 via a notch 34 in a wall portion defining at least in part said passageway 33, this notch being seen in FIG. 10 of the drawings.

The coolant recovery tank 23 is provided with its own filler neck 35 adapted to receive a simple filler cap, whereby the cooling system can be filled with coolant, as required via said coolant recovery tank 23. In order to facilitate the checking of the coolant level in the system, one side wall of the coolant recovery tank 23 is fitted with a sight glass 37 with which is associated a cold fill line 38. The coolant recovery tank 23 is also provided with a vent 39 to atmosphere.

In use of the radiator 1, whenever the pressure of the coolant in the core 15 and the header compartment 16 exceeds that predetermined by the pressure relief valve part of the filler cap 21, the valve member of said cap 21 is lifted from the seat 22 and coolant flows, into the coolant recovery tank 23 via the slot 32, passageway 33 and notch 34. When the coolant in the cooling system cools, coolant which has overflowed into the coolant recovery tank 23 is syphoned back into the header tank compartment 16, in conventional fashion as provided for by the double seal filler cap 21, and, because the notch 34 is essentially at the surface of the closure plate 31, then effectively nearly all of the coolant in the coolant recovery tank 23 can be syphoned to the header tank compartment 16 which would not be the case if, for example, the notch 34 were disposed above the level of the closure plate 31, whereby a substantial amount of coolant would always remain in the coolant recovery tank 23.

The fact that the coolant recovery tank 23 is vented to atmosphere means that there is an effective de-aeration of the overflow coolant, as with the known separate coolant recovery tank, whereby the advantage of this arrangement is taken without increasing the component count which is not the case with the known system as discussed above. An engine cooling system incorporating the above-described principles of the instant invention has the advantages of a reduced component count; a reduced installation time, as no separate coolant recovery bottle and attendant plumbing is involved; a better utilization of available space in the engine compartment of the vehicle; reduced service problems, particularly those relating to leaks in the plumbing of a separate coolant recovery bottle; and an enhancement to the appearance of the radiator due to the absence of external plumbing, brackets, etc.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

What is claimed is:

1. In a radiator for the cooling system of a vehicle, said radiator including a header tank and a bottom tank interconnected by a core through which air can flow, said header tank being provided with a filler tube fitted with a double seal filler cap through which coolant can flow in opposing directions depending on the conditions pertaining at a given instant in the header tank, said filler cap incorporating a pressure relief valve which opens when a predetermined coolant pressure is exceeded, the improvement comprising:

the header tank is formed integrally from a synthetic plastics material with a coolant recovery tank connected to the header tank by a passageway extending from the coolant recovery tank to a point in the filler tube of the header tank which is normally on the unpressurized side of the filler cap, but which is in flow communication with the pressurized side of the filler cap when the predetermined coolant pressure set by the filler cap is exceeded and the pressure relief valve is opened, said coolant recovery tank being provided with a sight glass with which is associated a cold fill line.

2. The radiator according to claim 1 wherein the coolant recovery tank is provided with a vent to atmosphere.

3. The radiator according to claim 2 wherein said coolant recovery tank is provided with a closure plate separating said coolant recovery tank from said header tank and having an outer face and an inner surface.

4. The radiator according to claim 3 wherein the outer face of the closure plate may be subjected to pressurized coolant in the cooling system to maintain the integrity of the seal between the closure plate and the coolant recovery tank.

5. The radiator according to claim 3 wherein one end of said passageway interconnecting the coolant recovery tank and the header tank is disposed substantially at the inner surface of the closure plate.

6. The radiator according to claim 3 wherein the passageway interconnecting the coolant recovery tank and the header tank communicates with a slot in the neck of the filler tube and with the interior of the coolant recovery tank.

7. The radiator according to claim 6 wherein the galley communicates with the coolant recovery tank via a recess in the surface to which the closure plate is attached.

8. The radiator according to claim 7 wherein the coolant recovery tank is provided with its own filler neck fitted with a filler cap.

* * * * *